US008061342B2

(12) United States Patent
Christopher et al.

(10) Patent No.: US 8,061,342 B2
(45) Date of Patent: Nov. 22, 2011

(54) PAINTBALL LOADER

(75) Inventors: James T. Christopher, Sachse, TX (US); Chris T. Goddard, Aubrey, TX (US)

(73) Assignee: Kee Action Sports I LLC, Sewell, NJ (US)

( * ) Notice: Subject to any disclaimer, the term of this patent is extended or adjusted under 35 U.S.C. 154(b) by 22 days.

(21) Appl. No.: 12/040,119

(22) Filed: Feb. 29, 2008

(65) Prior Publication Data

US 2009/0000608 A1 Jan. 1, 2009

Related U.S. Application Data

(63) Continuation of application No. 11/522,708, filed on Sep. 18, 2006, now abandoned, which is a continuation of application No. 10/851,837, filed on May 21, 2004, now abandoned, which is a continuation of application No. 09/949,440, filed on Sep. 7, 2001, now Pat. No. 6,792,933, which is a continuation-in-part of application No. 09/689,573, filed on Oct. 12, 2000, now Pat. No. 6,502,567, which is a continuation-in-part of application No. 09/465,440, filed on Dec. 16, 1999, now Pat. No. 6,213,110.

(51) Int. Cl.
*F41B 11/02* (2006.01)
*F41A 9/61* (2006.01)

(52) U.S. Cl. ..... 124/51.1; 124/49

(58) Field of Classification Search ..... 124/48, 124/49, 51.1; 221/258, 277
See application file for complete search history.

(56) References Cited

U.S. PATENT DOCUMENTS

| | | | |
|---|---|---|---|
| 1,332,992 | A | 3/1920 | Moore et al. |
| 1,332,993 | A | 3/1920 | Moore et al. |
| 1,403,689 | A | 1/1922 | Hyndman |
| 1,403,719 | A | 1/1922 | Szepe |
| 1,404,689 | A | 1/1922 | Fairweather |
| 1,743,576 | A | 1/1930 | Bigham |
| 1,867,513 | A | 7/1932 | Lahti |

(Continued)

FOREIGN PATENT DOCUMENTS

| | | |
|---|---|---|
| DE | 876370 | 5/1953 |

(Continued)

OTHER PUBLICATIONS

WARPIG.COM download "eVlution 2 Sneak Preview" by Bill Mills, Aug. 2001, pp. 1-4 World and Regional Paintball Information Guide.

(Continued)

*Primary Examiner* — Troy Chambers
(74) *Attorney, Agent, or Firm* — Volpe and Koenig, P.C.

(57) ABSTRACT

A rapid feed paintball loader for use on a paintball gun for force feeding paintballs is provided. The paintball loader includes a container for holding a plurality of paintballs, a paintball agitator rotating about an axis and rotatably mounted in the container, the paintball agitator including at least two fins extending substantially perpendicular to the axis of rotation, the fins spaced apart from each other forming a gap therebetween large enough to accommodate more than one paintball. At least two paintballs are positioned in the gap between the fins. A motor is configured to rotate the paintball agitator. The container includes an exit tube exiting from the bottom portion of the container and leading to an inlet tube of the paintball gun. A microprocessor and sensor may also be provided. The agitator may include a central dome-shaped area.

6 Claims, 9 Drawing Sheets

U.S. PATENT DOCUMENTS

| | | | | |
|---|---|---|---|---|
| 1,954,093 | A | | 4/1934 | Nelson |
| 2,064,888 | A | | 6/1935 | Dickinson |
| 2,307,015 | A | | 1/1943 | Boynton |
| 2,338,984 | A | | 1/1944 | Van Horn et al. |
| 2,357,951 | A | | 9/1944 | Hale |
| 2,398,263 | A | | 4/1946 | Trimbach |
| 2,451,521 | A | | 10/1948 | Uglum |
| 2,526,969 | A | | 10/1950 | Powers |
| 2,639,904 | A | | 5/1953 | McMaster |
| 2,641,412 | A | | 6/1953 | Byberg |
| 2,676,633 | A | | 4/1954 | Lohre et al. |
| RE23,951 | E | | 2/1955 | Graham |
| 2,716,973 | A | | 9/1955 | Desi |
| 3,089,476 | A | | 5/1963 | Wolverton |
| 3,134,301 | A | | 5/1964 | Even |
| 3,248,008 | A | | 4/1966 | Meierjohan |
| 3,384,354 | A | | 5/1968 | Albrecht et al. |
| 3,410,453 | A | | 11/1968 | Lawrence |
| 3,467,073 | A | | 9/1969 | Rhodes |
| 3,610,223 | A | | 10/1971 | Green |
| 3,630,118 | A | | 12/1971 | Stoner |
| 3,695,246 | A | | 10/1972 | Filippi et al. |
| 3,724,437 | A | | 4/1973 | Halstead |
| 3,745,687 | A | | 7/1973 | Koon, Jr. |
| 3,766,901 | A | | 10/1973 | Cleary et al. |
| 3,777,732 | A | | 12/1973 | Holloway et al. |
| 3,788,298 | A | | 1/1974 | Hale |
| 3,789,891 | A | | 2/1974 | Bosch |
| 3,807,379 | A | | 4/1974 | Vodinh |
| 3,814,283 | A | | 6/1974 | Cioth |
| 3,844,267 | A | | 10/1974 | Mohr |
| 3,855,988 | A | | 12/1974 | Sweeton |
| 3,867,921 | A | | 2/1975 | Politzer |
| 3,894,657 | A | | 7/1975 | Eckmayr |
| 3,930,486 | A | | 1/1976 | Kahelin |
| 3,978,841 | A | | 9/1976 | Yarur et al. |
| 3,990,426 | A | | 11/1976 | Stokes |
| 4,021,036 | A | | 5/1977 | Nelson et al. |
| 4,027,646 | A | | 6/1977 | Sweeton |
| 4,034,644 | A | | 7/1977 | Hupp et al. |
| 4,073,280 | A | | 2/1978 | Koehn et al. |
| 4,112,911 | A | | 9/1978 | Petrick, Sr. |
| 4,116,192 | A | | 9/1978 | Scott |
| 4,148,415 | A | | 4/1979 | Florida et al. |
| 4,185,824 | A | | 1/1980 | Natwick |
| 4,207,857 | A | * | 6/1980 | Balka, Jr. ..... 124/56 |
| 4,280,697 | A | | 7/1981 | Yuasa |
| 4,299,383 | A | | 11/1981 | Yuasa |
| 4,332,097 | A | | 6/1982 | Taylor, Jr. |
| 4,391,264 | A | | 7/1983 | Abrham et al. |
| 4,396,193 | A | | 8/1983 | Reinhardt et al. |
| 4,481,862 | A | | 11/1984 | Wiethoff et al. |
| 4,487,103 | A | | 12/1984 | Atchisson |
| 4,502,455 | A | | 3/1985 | Stokes |
| 5,502,455 | A | | 3/1985 | Ophir et al. |
| 4,563,999 | A | | 1/1986 | Miehlich |
| 4,646,709 | A | | 3/1987 | Kholin |
| 4,676,137 | A | | 6/1987 | Stockton et al. |
| 4,695,954 | A | | 9/1987 | Rose et al. |
| 4,745,842 | A | | 5/1988 | Shou-Fu |
| 4,748,600 | A | | 5/1988 | Urquhart |
| 4,759,435 | A | | 7/1988 | Cedrone |
| 4,765,223 | A | | 8/1988 | Beckmann |
| 4,817,955 | A | | 4/1989 | Hickson et al. |
| 4,819,609 | A | | 4/1989 | Tippmann |
| 4,834,060 | A | | 5/1989 | Greene |
| 4,850,330 | A | | 7/1989 | Nagayoshi |
| 4,896,646 | A | | 1/1990 | Kahelin et al. |
| 4,923,066 | A | | 5/1990 | Ophir et al. |
| 4,926,742 | A | | 5/1990 | Ma et al. |
| 4,930,400 | A | | 6/1990 | Brandl et al. |
| 4,936,282 | A | | 6/1990 | Dobbins et al. |
| 4,951,548 | A | | 8/1990 | Wixon et al. |
| 4,951,644 | A | | 8/1990 | Viviani |
| 4,965,951 | A | | 10/1990 | Miller et al. |
| 4,986,251 | A | | 1/1991 | Lilley |
| 4,993,400 | A | | 2/1991 | Fitzwater |
| 5,042,685 | A | | 8/1991 | Moulding, Jr. et al. |
| 5,061,222 | A | | 10/1991 | Suris |
| 5,063,905 | A | | 11/1991 | Farrell |
| 5,097,816 | A | | 3/1992 | Miller |
| 5,097,985 | A | | 3/1992 | Jones |
| 5,166,457 | A | | 11/1992 | Lorenzetti |
| 5,233,125 | A | | 8/1993 | Bouver et al. |
| 5,251,906 | A | | 10/1993 | Heller et al. |
| 5,282,454 | A | * | 2/1994 | Bell et al. ..... 124/49 |
| 5,322,283 | A | | 6/1994 | Ritchie et al. |
| 5,335,579 | A | | 8/1994 | David |
| 5,353,712 | A | | 10/1994 | Olson |
| 5,361,746 | A | | 11/1994 | Szente |
| 5,383,442 | A | | 1/1995 | Tippmann |
| 5,456,153 | A | | 10/1995 | Bentley et al. |
| 5,464,208 | A | | 11/1995 | Pierce |
| 5,490,493 | A | | 2/1996 | Salansky |
| 5,497,758 | A | | 3/1996 | Dobbins et al. |
| 5,505,188 | A | | 4/1996 | Williams |
| 5,507,271 | A | | 4/1996 | Actor |
| 5,511,333 | A | | 4/1996 | Farrell |
| 5,520,171 | A | | 5/1996 | David |
| 5,542,570 | A | | 8/1996 | Nottingham et al. |
| 5,555,662 | A | | 9/1996 | Teetzel |
| 5,561,258 | A | | 10/1996 | Bentley et al. |
| 5,600,083 | A | | 2/1997 | Bentley et al. |
| 5,673,812 | A | | 10/1997 | Nelson |
| 5,675,110 | A | | 10/1997 | Gyre et al. |
| 5,722,383 | A | | 3/1998 | Tippmann |
| 5,727,538 | A | | 3/1998 | Ellis |
| 5,736,720 | A | | 4/1998 | Bell et al. |
| 5,749,797 | A | | 5/1998 | Sunseri et al. |
| 5,755,056 | A | | 5/1998 | Danner et al. |
| 5,771,875 | A | | 6/1998 | Sullivan |
| 5,784,985 | A | | 7/1998 | Lodico et al. |
| 5,791,325 | A | | 8/1998 | Anderson |
| 5,794,606 | A | | 8/1998 | Deak |
| 5,809,983 | A | | 9/1998 | Stoneking |
| 5,816,232 | A | | 10/1998 | Bell |
| 5,819,715 | A | | 10/1998 | Haneda et al. |
| 5,836,583 | A | | 11/1998 | Towers |
| 5,839,422 | A | | 11/1998 | Ferris |
| 5,881,962 | A | | 3/1999 | Schmidt et al. |
| 5,887,578 | A | | 3/1999 | Backeris et al. |
| 5,947,100 | A | | 9/1999 | Anderson |
| 5,954,042 | A | | 9/1999 | Harvey |
| 6,032,395 | A | | 3/2000 | Bentley et al. |
| 6,055,975 | A | | 5/2000 | Gallagher et al. |
| 6,062,208 | A | | 5/2000 | Seefeldt et al. |
| 6,083,105 | A | | 7/2000 | Ronin et al. |
| 6,085,735 | A | | 7/2000 | Cheek, Jr. |
| 6,109,252 | A | | 8/2000 | Stevens |
| 6,206,562 | B1 | | 3/2001 | Eyraud et al. |
| 6,213,110 | B1 | | 4/2001 | Christopher et al. |
| 6,220,237 | B1 | | 4/2001 | Johnson et al. |
| 6,305,367 | B1 | | 10/2001 | Kotsiopoulos et al. |
| 6,311,682 | B1 | | 11/2001 | Rice et al. |
| 6,325,233 | B1 | | 12/2001 | Harris |
| 6,327,953 | B1 | | 12/2001 | Andresen |
| 6,347,621 | B1 | | 2/2002 | Guthrie |
| 6,374,819 | B1 | | 4/2002 | Ming-Hsien |
| 6,408,836 | B1 | | 6/2002 | Ming Hsien |
| 6,408,837 | B1 | | 6/2002 | Johnson et al. |
| D459,767 | S | | 7/2002 | Rushton |
| 6,415,781 | B1 | | 7/2002 | Perrone |
| 6,418,919 | B1 | | 7/2002 | Perrone |
| 6,425,781 | B1 | | 7/2002 | Bernstein et al. |
| 6,460,530 | B1 | | 10/2002 | Backeris et al. |
| 6,467,473 | B1 | | 10/2002 | Kotsiopoulos |
| 6,468,879 | B1 | | 10/2002 | Lamure et al. |
| 6,481,432 | B2 | | 11/2002 | Rushton et al. |
| 6,488,019 | B2 | | 12/2002 | Kotsiopoulos |
| 6,502,567 | B1 | | 1/2003 | Christopher et al. |
| 6,520,854 | B1 | | 2/2003 | McNally |
| 6,526,955 | B1 | | 3/2003 | Juan |
| 6,588,412 | B2 | | 7/2003 | Ferrara et al. |
| 6,591,824 | B2 | | 7/2003 | Hatcher |
| 6,609,511 | B2 | | 8/2003 | Kotsiopoulos |
| 6,615,814 | B1 | | 9/2003 | Rice et al. |
| 6,644,293 | B2 | | 11/2003 | Jong |

| | | | | |
|---|---|---|---|---|
| 6,666,203 | B2 | 12/2003 | Maeda et al. | |
| 6,684,873 | B1 | 2/2004 | Anderson | |
| 6,701,907 | B2 | 3/2004 | Christopher et al. | |
| 6,708,685 | B2 | 3/2004 | Masse | |
| 6,722,355 | B1 | 4/2004 | Andrews, Jr. | |
| 6,725,852 | B1 | 4/2004 | Yokota et al. | |
| 6,729,321 | B2 | 5/2004 | Ho | |
| 6,729,497 | B2 | 5/2004 | Rice et al. | |
| 6,739,322 | B2 | 5/2004 | Rice et al. | |
| 6,739,323 | B2 | 5/2004 | Tippmann, Jr. | |
| 6,742,512 | B1 | 6/2004 | Ho | |
| 6,752,137 | B2 | 6/2004 | Brunette | |
| 6,792,933 | B2 | 9/2004 | Christopher et al. | |
| 6,802,306 | B1 | 10/2004 | Rice | |
| 6,860,258 | B2 | 3/2005 | Farrell | |
| 6,889,680 | B2 | 5/2005 | Christopher et al. | |
| 6,899,328 | B2 | 5/2005 | Halliburton et al. | |
| 6,915,792 | B1 | 7/2005 | Sheng | |
| 6,978,776 | B2 | 12/2005 | Hamilton | |
| 6,981,493 | B1 | 1/2006 | Poteracku | |
| 7,000,603 | B1 | 2/2006 | Steenbeke | |
| 7,017,569 | B2 | 3/2006 | Jong | |
| 7,021,302 | B2 | 4/2006 | Neumaster | |
| 7,040,505 | B2 | 5/2006 | Hashimoto et al. | |
| 7,077,118 | B2 | 7/2006 | Lewis | |
| D535,339 | S | 1/2007 | Broersma | |
| 7,159,585 | B2 | 1/2007 | Quinn et al. | |
| 7,210,473 | B2 | 5/2007 | Jong | |
| 7,216,641 | B2 | 5/2007 | Friesen et al. | |
| 7,222,617 | B2 | 5/2007 | Andresen | |
| D544,047 | S | 6/2007 | Bell et al. | |
| 7,234,456 | B2 | 6/2007 | Andresen | |
| 7,270,120 | B2 | 9/2007 | Broersma et al. | |
| 7,270,121 | B2 | 9/2007 | Lubben | |
| 7,322,347 | B2 | 1/2008 | Broersma | |
| 7,322,348 | B2 | 1/2008 | Chen | |
| 7,343,909 | B2 | 3/2008 | Christopher | |
| D567,302 | S | 4/2008 | Choi | |
| D567,303 | S | 4/2008 | Neumaster | |
| 7,357,129 | B2 | 4/2008 | Neumaster et al. | |
| 7,357,130 | B2 | 4/2008 | Broersma | |
| D572,318 | S | 7/2008 | Broersma | |
| 7,428,899 | B2 * | 9/2008 | Andresen | 124/51.1 |
| 7,445,002 | B2 | 11/2008 | Christopher et al. | |
| D584,776 | S | 1/2009 | Stevens | |
| 7,617,817 | B1 | 11/2009 | Kulp | |
| 7,770,569 | B2 | 8/2010 | Andresen | |
| 7,779,825 | B2 | 8/2010 | Estrate | |
| 7,921,835 | B2 | 7/2011 | Campo et al. | |
| 2002/0014230 | A1 | 2/2002 | Christopher et al. | |
| 2002/0020402 | A1 | 2/2002 | Kotsiopoulos | |
| 2002/0059927 | A1 | 5/2002 | Woods | |
| 2002/0112713 | A1 | 8/2002 | Backeris et al. | |
| 2002/0117159 | A1 | 8/2002 | Kotsiopoulos et al. | |
| 2003/0024520 | A1 | 2/2003 | Dobbins | |
| 2003/0047173 | A1 | 3/2003 | Juan | |
| 2003/0079731 | A1 | 5/2003 | Dobbins | |
| 2004/0074487 | A1 | 4/2004 | Christopher et al. | |
| 2004/0074489 | A1 | 4/2004 | Neumaster et al. | |
| 2004/0112356 | A1 | 6/2004 | Hatcher | |
| 2004/0134475 | A1 | 7/2004 | Jong | |
| 2004/0194772 | A1 | 10/2004 | Hamilton | |
| 2004/0211402 | A1 | 10/2004 | Christopher et al. | |
| 2004/0245276 | A1 | 12/2004 | Hashimoto et al. | |
| 2005/0028801 | A1 | 2/2005 | Lewis | |
| 2005/0121015 | A1 | 6/2005 | Postorivo, Jr. | |
| 2005/0188974 | A1 | 9/2005 | Pedicini et al. | |
| 2005/0188978 | A1 | 9/2005 | Tiberius et al. | |
| 2005/0217653 | A1 | 10/2005 | Christopher et al. | |
| 2005/0241628 | A1 | 11/2005 | Hatcher | |
| 2005/0274370 | A1 | 12/2005 | Lubben | |
| 2005/0274371 | A1 | 12/2005 | Lubben | |
| 2005/0284456 | A1 | 12/2005 | Chipley | |
| 2005/0284457 | A1 | 12/2005 | Hatcher | |
| 2006/0005823 | A1 | 1/2006 | Quinn | |
| 2006/0032488 | A1 | 2/2006 | Telford | |
| 2006/0037597 | A1 | 2/2006 | Wood | |
| 2006/0054151 | A1 | 3/2006 | Christopher et al. | |
| 2006/0086347 | A1 | 4/2006 | Hedberg | |
| 2006/0124118 | A1 | 6/2006 | Dobbins | |
| 2006/0130821 | A1 | 6/2006 | Hamilton | |
| 2006/0157041 | A1 | 7/2006 | Friesen | |
| 2006/0196489 | A1 | 9/2006 | Campo | |
| 2006/0249131 | A1 | 11/2006 | Broersma | |
| 2006/0254572 | A1 | 11/2006 | Hall | |
| 2007/0012303 | A1 | 1/2007 | Christopher et al. | |
| 2007/0012304 | A1 | 1/2007 | van Dorsser et al. | |
| 2007/0017494 | A1 | 1/2007 | Andresen | |
| 2007/0017495 | A1 | 1/2007 | Andresen | |
| 2007/0056573 | A1 | 3/2007 | Campo | |
| 2007/0062506 | A1 | 3/2007 | Bell | |
| 2007/0101981 | A1 | 5/2007 | Chen | |
| 2007/0113834 | A1 | 5/2007 | Spicer | |
| 2007/0137631 | A1 | 6/2007 | Christopher | |
| 2007/0175463 | A1 | 8/2007 | Higgins et al. | |
| 2007/0181117 | A1 | 8/2007 | Tippmann et al. | |
| 2007/0215137 | A1 | 9/2007 | Jones et al. | |
| 2007/0246479 | A1 | 10/2007 | Andresen | |
| 2007/0256676 | A1 | 11/2007 | Orvis et al. | |
| 2008/0017178 | A1 | 1/2008 | Marques et al. | |
| 2008/0047535 | A1 | 2/2008 | Handel | |
| 2008/0047536 | A1 | 2/2008 | Chen | |
| 2008/0047537 | A1 | 2/2008 | Kulp et al. | |
| 2008/0087264 | A1 | 4/2008 | Postorivo | |
| 2008/0178859 | A1 | 7/2008 | Moore et al. | |
| 2009/0000608 | A1 | 1/2009 | Christopher et al. | |
| 2009/0025700 | A1 | 1/2009 | Andersen | |
| 2009/0133680 | A1 | 5/2009 | Christopher et al. | |
| 2009/0241929 | A1 | 10/2009 | Italia et al. | |

FOREIGN PATENT DOCUMENTS

| | | |
|---|---|---|
| DE | 2035097 | 8/1982 |
| DE | 3721527 | 1/1989 |
| DE | 4343870 | 6/1994 |
| DE | 19922589 | 12/2000 |
| EP | 0075970 | 4/1983 |
| EP | 01054228 | 11/2000 |
| EP | 01653189 | 5/2006 |
| FR | 921527 | 5/1947 |
| GB | 470201 | 8/1937 |
| GB | 551077 | 2/1943 |
| GB | 2322438 | 8/1998 |
| JP | 1179898 | 7/1989 |
| JP | 6-325233 A | 11/1994 |
| JP | 6325233 | 11/1994 |
| WO | 98/13660 | 4/1998 |
| WO | 01/44745 | 6/2001 |
| WO | 02/42708 | 5/2002 |
| WO | 03087698 | 10/2003 |
| WO | 2007/035601 | 3/2007 |
| WO | 2007033309 | 3/2007 |
| WO | 2007044546 | 4/2007 |
| WO | 2007044822 | 4/2007 |
| WO | 2007/098554 A1 | 9/2007 |
| WO | 2008104061 | 4/2008 |

OTHER PUBLICATIONS

Co-pending U.S. Appl. No. 09/465,440 (Now Issued Patent No. 6,213,110, Issued Apr. 10, 2001) Title: Rapid Feed Paintball Loader Inventor: Christopher et al. "Notice of Allowance and Issue Fee Due" mailed Dec. 4, 2000.

Co-pending U.S. Appl. No. 09/465,440 (Now Issued Patent No. 6,213,110, Issued Apr. 10, 2001) Title: Rapid Feed Paintball Loader Inventor: Christopher et al. "Non-Final Office Action" mailed Jun. 21, 2000.

Co-pending U.S. Appl. No. 09/689,573 (Now U.S. Patent No. 6,502,567, Issued on Jan. 7, 2003) Titile: Rapid Feed Paintball Loader With Pivotable Deflector Inventor: Christopher et al. "Final Office Action" mailed Dec. 19, 2001.

Co-pending U.S. Appl. No. 09/689,573 (Now U.S. Patent No. 6,502,567, Issued on Jan. 7, 2003) Title: Rapid Feed Paintball Loader With Pivotable Deflector Inventor: Christopher et al. "Final Office Action" mailed Jun. 10, 2002.

Co-pending U.S. Appl. No. 09/689,573 (Now U.S. Patent No. 6,502,567, Issued on Jan. 7, 2003) Title: Rapid Feed Paintball Loader With Pivotable Deflector Inventor: Christopher et al. "Notice of Allowance" mailed Aug. 20, 2002.
Co-pending U.S. Appl. No. 09/949,440 (Now U.S. Patent No. 6,792,933, Issued on Sep. 21, 2004) Title: Drive Cone for Paintball Loader Inventor: Christopher et al. "Notice of Allowance" mailed Nov. 18, 2003.
Co-pending U.S. Appl. No. 09/949,440 (Now U.S. Patent No. 6,792,933, Issued on Sep. 21, 2004) Title: Drive Cone for Paintball Loader Inventor: Christopher et al. "Final Office Action" mailed Jun. 25, 2003.
Co-pending U.S. Appl. No. 09/949,440 (Now U.S. Patent No. 6,792,933, Issued on Sep. 21, 2004) Title: Drive Cone for Paintball Loader Inventor: Christopher et al. "Non-Final Office Action" mailed Mar. 7, 2003.
Co-pending U.S. Appl. No. 09/949,440 (Now U.S. Patent No. 6,792,933, Issued on Sep. 21, 2004) Title: Drive Cone for Paintball Loader Inventor: Christopher et al. "Notice of Allowance" mailed Oct. 1, 2002.
Co-pending U.S. Appl. No. 09/949,440 (Now U.S. Patent No. 6,792,933, Issued on Sep. 21, 2004) Title: Drive Cone for Paintball Loader Inventor: Christopher et al. Non-Final Office Action mailed Mar. 22, 2002.
Co-pending U.S. Appl. No. 10/092,220 (Now U.S. Patent No. 6,701,907, Issued Mar. 9, 2004) Title: Spring Loaded Feed Mechanism for Paintball Loader Inventor: Christopher et al. "Notice of Allowance" mailed Oct. 23, 2003.
Co-pending U.S. Appl. No. 10/092,220 (Now U.S. Patent No. 6,701,907, Issued Mar. 9, 2004) Title: Spring Loaded Feed Mechanism for Paintball Loader Inventor: Christopher et al. "Non-Final Office Action" mailed Aug. 4, 2003.
Co-pending U.S. Appl. No. 10/092,220 (Now U.S. Patent No. 6,701,907, Issued Mar. 9, 2004) Title: Spring Loaded Feed Mechanism for Paintball Loader Inventor: Christopher et al. "Advisory Action" mailed Jul. 9, 2003.
Co-pending U.S. Appl. No. 10/092,220 (Now U.S. Patent No. 6,701,907, Issued Mar. 9, 2004) Title: Spring Loaded Feed Mechanism for Paintball Loader Inventor: Christopher et al. "Final Office Action" mailed Jan. 17, 2003.
Co-pending U.S. Appl. No. 10/092,220 (Now U.S. Patent No. 6,701,907, Issued Mar. 9, 2004) Title: Spring Loaded Feed Mechanism for Paintball Loader Inventor: Christopher et al. "Notice of Allowance" mailed Nov. 27, 2002.
Co-pending U.S. Appl. No. 10/092,220 (Now U.S. Patent No. 6,701,907, Issued Mar. 9, 2004) Title: Spring Loaded Feed Mechanism for Paintball Loader Inventor: Christopher et al. "Non-Final Office Action" mailed May 24, 2002.
Co-pending U.S. Appl. No. 10/851,837 (U.S. Patent Application Publication No. US 2004/0211402 A1, published Oct. 28, 2004, now abandoned) Title: Rapid Feed Paintball Loader Inventor: Christopher et al. "Final Rejection" mailed Mar. 16, 2006.
Co-pending U.S. Appl. No. 10/851,837 (U.S. Patent Application Publication No. US 2004/0211402 A1, published Oct. 28, 2004, now abandoned) Title: Rapid Feed Paintball Loader Inventor: Christopher et al. "Non-Final Rejection" mailed Jul. 25, 2005.
Co-pending U.S. Appl. No. 10/851,837 (U.S. Patent Application Publication No. US 2004/0211402 A1, published Oct. 28, 2004, now abandoned) Title: Rapid Feed Paintball Loader Inventor: Christopher et al. "Non-Final Rejection" mailed Oct. 25, 2004.
Co-pending U.S. Appl. No. 11/031,952 (Re-Issue of U.S. Patent No. 6,213,110 issued on Apr. 10, 2001) Title: Rapid Feed Paintball Loader With Pivotable Deflector Inventor: Christopher et al. "Non-Final Rejection" mailed Apr. 21, 2009.
Co-pending U.S. Appl. No. 11/031,952 (Re-Issue of U.S. Patent No. 6,213,110 issued on Apr. 10, 2001) Title: Rapid Feed Paintball Loader with Pivotable Deflector Inventor: Christopher et al. "Non-Final Rejection" (under 37 CFR 1.105) mailed Apr. 23, 2008.
Co-pending U.S. Appl. No. 11/372,450 (Re-Issue of U.S. Patent No. 6,701,907, issued on Mar. 9, 2004) Title: Spring Loaded Feed Mechanism for Paintball Loader Inventor: Christopher et al. "Non-Final Rejection" mailed Nov. 18, 2009.
Co-pending U.S. Appl. No. 11/372,450 (Re-Issue of U.S. Patent No. 6,701,907, issued on Mar. 9, 2004) Title: Spring Loaded Feed Mechanism for Paintball Loader Inventor: Christopher et al. "Non-Final Rejection" (under 37 CFR 1.105) mailed Apr. 23, 2008.
Co-pending U.S. Appl. No. 11/522,708 (Patent Application Publication No. US 2007/0012303 A1) (now abandoned) Title: Drive Cone for Paintball Loader "Final Rejection" mailed Aug. 30, 2007.
Co-pending U.S. Appl. No. 11/522,708 (Patent Application Publication No. US 2007/0012303 A1) (now abandoned) Title: Drive Cone for Paintball Loader "Final Rejection" mailed Feb. 27, 2007.
WARPIG—World And Regional Paintball Information Guide, http://www.warpig.com/paintball/technical/loaders/halo/index.shtml,
WARPIG.COM, Odyssey Readies Halo for Production, By Bill Mills, Jun. 2001, pp. 1 to 5.
WARPIG—World And Regional Paintball Information Guide, http://www.warpig.com/paintball/technical/loaders/halo/review.shtml,
WARPIG.COM, Odyssey Halo By Bill Mills, Dec. 2001, pp. 1 to 7.
Odyssey Halo B Paintball Hopper Review, http://www.paintball-gun-review.com/hopper-reviews/odyssey-halo-b . . . , Paintball Gun Review, Odyssey Halo B Paintball Hopper Review, 2004 Paintball-Gun-Review.com, pp. 1 to 4.
www.ODYSSEYPAINTBALL.com http://web.archive.org/web/20030205112543/http://www.odysseypain . . . , Odyssey Paintball Products, Understanding Halo B, pp. 1 to 3.
WARPIG.com download: Brass Eagle's eVLution Loader by Bill Mills, Aug. 2000 (6 pages).
WARPIG.com download: WARPIG Ballistic Labs Report: Revolution Response Times by Bill Mills, Aug. 200 (5 pages).
U.S. Appl. No. 11/031,952 (Reissue of U.S. Patent No. 6,213,110 issued Apr. 10, 2001) Title: Rapid Feed Paintball Loader With Pivotable Deflector Inventor: Christopher et al. Non-Final Rejection mailed Apr. 26, 2011.
U.S. Appl. No. 11/372,450 (Reissue of U.S. Patent No. 6,701,907 issued Mar. 9, 2004) Title: Spring Loaded Feed Mechanism for Paintball Loader Inventor: Christopher et al. Non-Final Rejection mailed Mar. 29, 2011.
U.S. Appl. No. 90/009,794 (Reexam of 6,213,110 issued Apr. 10, 2001) Title: Rapid Feed Paintball Loader Inventor: Christopher et al. Request for Reexamination As Filed on Jul. 31, 2010.
U.S. Appl. No. 90/009,794 (Reexam of 6,213,110 issued Apr. 10, 2001) Title: Rapid Feed Paintball Loader Inventor: Christopher et al. Non-Final Rejection mailed Dec. 3, 2010.
U.S. Appl. No. 90/009,794 (Reexam of 6,213,110 issued Apr. 10, 2001) Title: Rapid Feed Paintball Loader Inventor: Christopher et al. Final Rejection mailed Feb. 14, 2011.
U.S. Appl. No. 90/009,794 (Reexam of 6,213,110 issued Apr. 10, 2001) Title: Rapid Feed Paintball Loader Inventor: Christopher et al. Advisory Action mailed May 4, 2011.
U.S. Appl. No. 90/009,715 (Reexam of 6,502,567 issued Jan. 7, 2003) Title: Rapid Feed Paintball Loader With Pivotable Deflector Inventor: Christopher et al. Request for Reexamination As Filed on Mar. 31, 2010.

* cited by examiner

PAINTBALL LOADER

CROSS REFERENCE TO RELATED APPLICATIONS

This application is a continuation application of U.S. patent application Ser. No. 11/522,708, which is a continuation application of U.S. patent application Ser. No. 10/851,837, now abandoned, which is a continuation of U.S. patent application Ser. No. 09/949,440, now U.S. Pat. No. 6,792,933, which is a continuation-in-part of a U.S. patent application Ser. No. 09/689,573, now U.S. Pat. No. 6,502,567, which is a continuation-in-part of U.S. patent application Ser. No. 09/465,440, now U.S. Pat. No. 6,213,110, which are hereby incorporated in their entirety by reference herein.

FIELD OF INVENTION

This invention relates to paintball loaders, and more particularly, to a drive cone for use on a paintball loader for feeding paintballs into a paintball gun

BACKGROUND

A popular war game has developed over the years, which uses paintball guns. Players use the paintball guns to shoot paintballs. These paintballs are gelatin-covered spherical capsules filled with paint. During play of the game, the players on each team advance towards each other. A player is eliminated from the game when the player is hit by a paintball fired from an opposing player's gun. When the paintball hits a player, a "splat" of paint is left on the player.

Typically, an existing paintball loader includes a housing which is placed on an upper portion of a paintball gun. The housing is shaped to hold a large quantity of paintballs. At the bottom of the housing is an outlet tube through which the paintballs drop by the force of gravity. The outlet tube leads to an inlet tube located on the upper portion of the gun.

During the operation of existing paintball loaders, paintballs sequentially drop by gravity through the outlet tube into the inlet tube of the gun. The inlet tube directs each paintball into the firing chamber of the gun, where the paintball is propelled outwardly from the gun by compressed air.

Co-pending U.S. patent application Ser. No. 09/1689,573 ('573), now U.S. Pat. No. 6,502,567, describes a paintball feed system providing enhanced performance over existing paintball feed systems. Additionally, '573 discloses a paintball loader which reliably and forcibly delivers paintballs to a paintball gun at a rapid, selectable rate, while actively preventing paintball jams. However, paintball jams may still occur in the loader disclosed in '573. Specifically, the disclosed paintball loader utilizes a plurality of fins spaced at such a distance as to create gaps to accommodate a single paintball. Due to the close proximity of the fins, there is a tendency for the paintballs to partially fall into a gap, which can result in a paintball jam. In addition, if a paintball breaks within the paintball loader, because of the large amount of fins and the small area of the gaps, cleaning the paintball loader can be difficult. Since existing paintball loaders utilize several fins, space for which paintballs could be accommodated are lost to allow space for the fins. Thus, the paintball feed rate is reduced for each rotation of the cone because of this lost space.

It would be a distinct advantage to have a drive cone which feeds the paintballs at a faster rate, while preventing jams of partially fallen paintballs into the gaps located between the fins. It is an object of the present invention to provide such an apparatus.

SUMMARY

In one aspect, the present invention is a rapid feed paintball loader for use on a paintball gun. The paintball loader includes a container for holding a plurality of paintballs and a drive cone rotatably mounted on a bottom portion of the container. At least one fin is affixed to a top feed surface of the drive cone. The fin divides or separates the top feed surface into at least a gap or section which is preferably large enough to accommodate more than one paintball. The loader also includes a motor that rotates the drive cone. In addition, an exit tube exits from the bottom portion of the container and leads to an inlet tube of the paintball gun. The motor actuates upon demand.

In another aspect, the present invention is a drive cone for use on a paintball loader of a paintball gun having a container for holding a plurality of paintballs and an exit tube located on the container leading to the paintball gun. The drive cone includes a drive cone rotatably mounted on a bottom portion of the container and at least one fin affixed to a top feed surface of the drive cone. The fin divides or separates the top feed surface of the drive cone into at least one gap which is preferably large enough to accommodate more than one paintball. The drive cone receives paintballs from the container and drives the paintballs from the gap into the exit tube.

In still another aspect, the present invention is a rapid feed paintball loader for use on a paintball gun. The paintball loader includes a container for holding a plurality of paintballs and at least one fin located at a bottom portion of the container. The fin divides or separates the top feed surface into at least one gap that is preferably large enough to accommodate at least one paintball. The fin rotates on an axis running perpendicularly through the bottom portion of the container. The paintball loader also includes an exit tube exiting from the bottom portion of the container and leads to an inlet tube of the paintball gun. The exit tube has a sloped exit portion. In addition, a tube extension is mounted on an interior surface of the container adjacent to the sloped exit portion of the exit tube. The tube extension is mounted at a height which is above the top feed surface of the fin and has a radius of curvature that is approximately equal to the radius of a paintball. The paintball loader also may include a deflector for deflecting paintballs downward into the gap or upward to pass over the tube extension. The deflector is pivotably mounted on the interior surface of the container adjacent to the tube extension. The deflector is mounted at a height which is above the top feed surface of the fin and which is below a bottom portion of the tube extension. A motor rotates the drive cone upon demand.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF THE PREFERRED EMBODIMENT(S)

Figure 1:
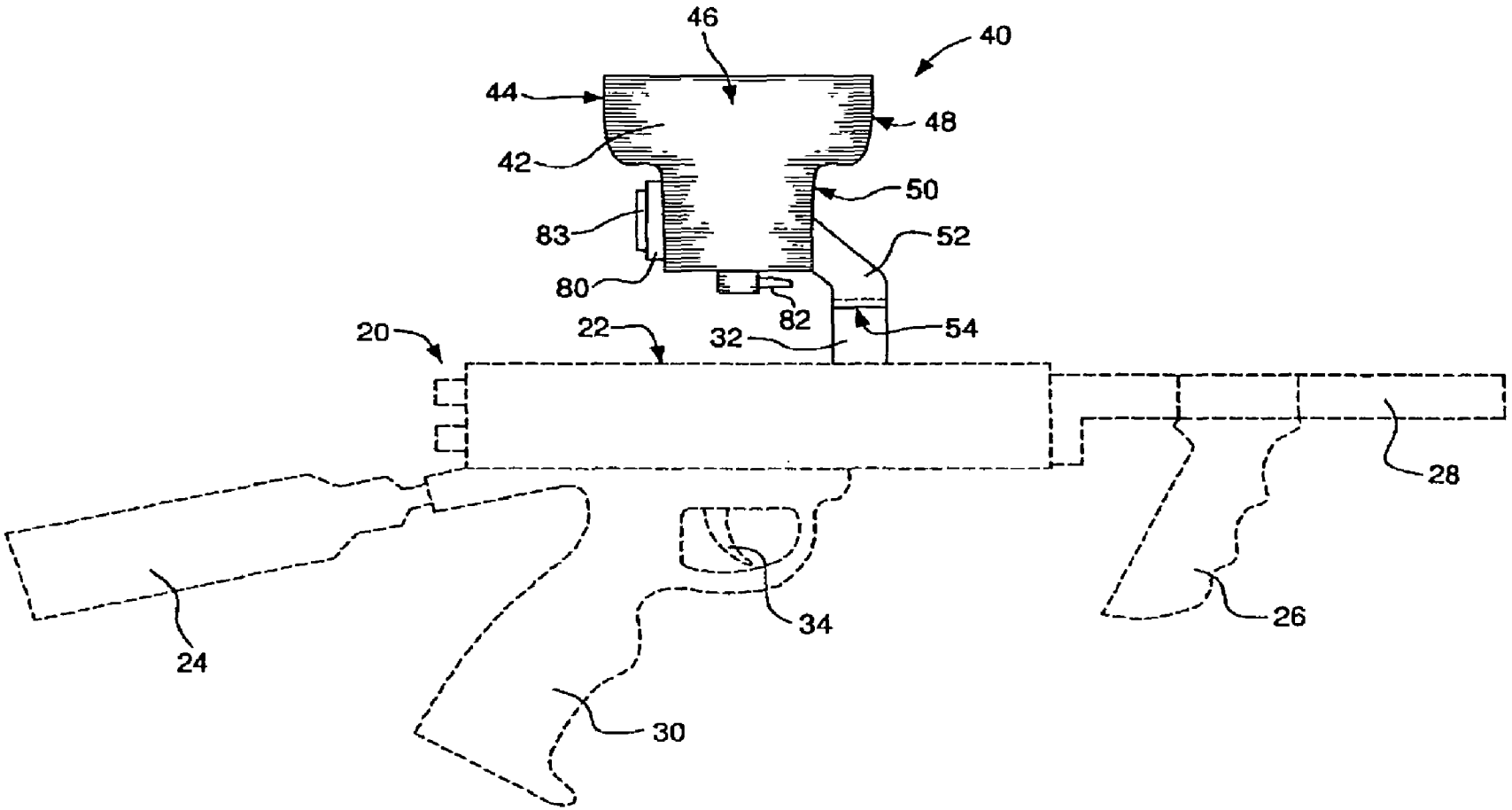
FIG. 1 is a side elevational view of a rapid feed paintball loader constructed in accordance with the teachings of the present invention and operatively attached to a representative paintball gun illustrated in phantom.

A drive cone for use in a paintball loader 40 for rapidly delivering paintballs while preventing paintball jams is disclosed. FIG. 1 is a side elevational view of a rapid feed paintball loader 40 constructed in accordance with the teachings of the present invention and operatively attached to a representative paintball gun 20 illustrated in phantom. The paintball gun 20 includes a main body 22, a compressed gas cylinder 24, a front handgrip 26, a barrel 28, and a rear handgrip 30. The paintball gun 20 also includes an inlet tube 32 leading to a firing chamber in the interior of the main body 22 and a trigger 34. The front handgrip 26 projects downwardly from the barrel 28 and provides an area for gripping by an operator of the paintball gun 20. The compressed gas cylinder 24 is typically secured to a rear portion of the paintball gun 20. The compressed gas cylinder 24 normally contains CO2, although any compressible gas may be used.

In operating the paintball gun 20, the trigger 34 is squeezed, thereby actuating the compressed gas cylinder 24 to release bursts of compressed gas. The bursts of gas are used to eject paintballs 68 outwardly through the barrel 28. The paintballs 68 are continually fed by the paintball loader 40 through the inlet tube 32 to the firing chamber. Although FIG. 1 depicts an automatic paintball gun 20, the paintball gun 20 may also be a semi-automatic gun.

The rapid feed paintball loader 40 includes a paintball container 42 having a container wall 44 forming an interior area 46. The container 42 is divided into an upper portion 48 and a lower portion 50. An exit tube 52 leads from the bottom portion of the container 42 to an outlet opening 54. The exit tube 52 is positioned on top of the inlet tube 32 of the paintball gun 20.

Figure 2:
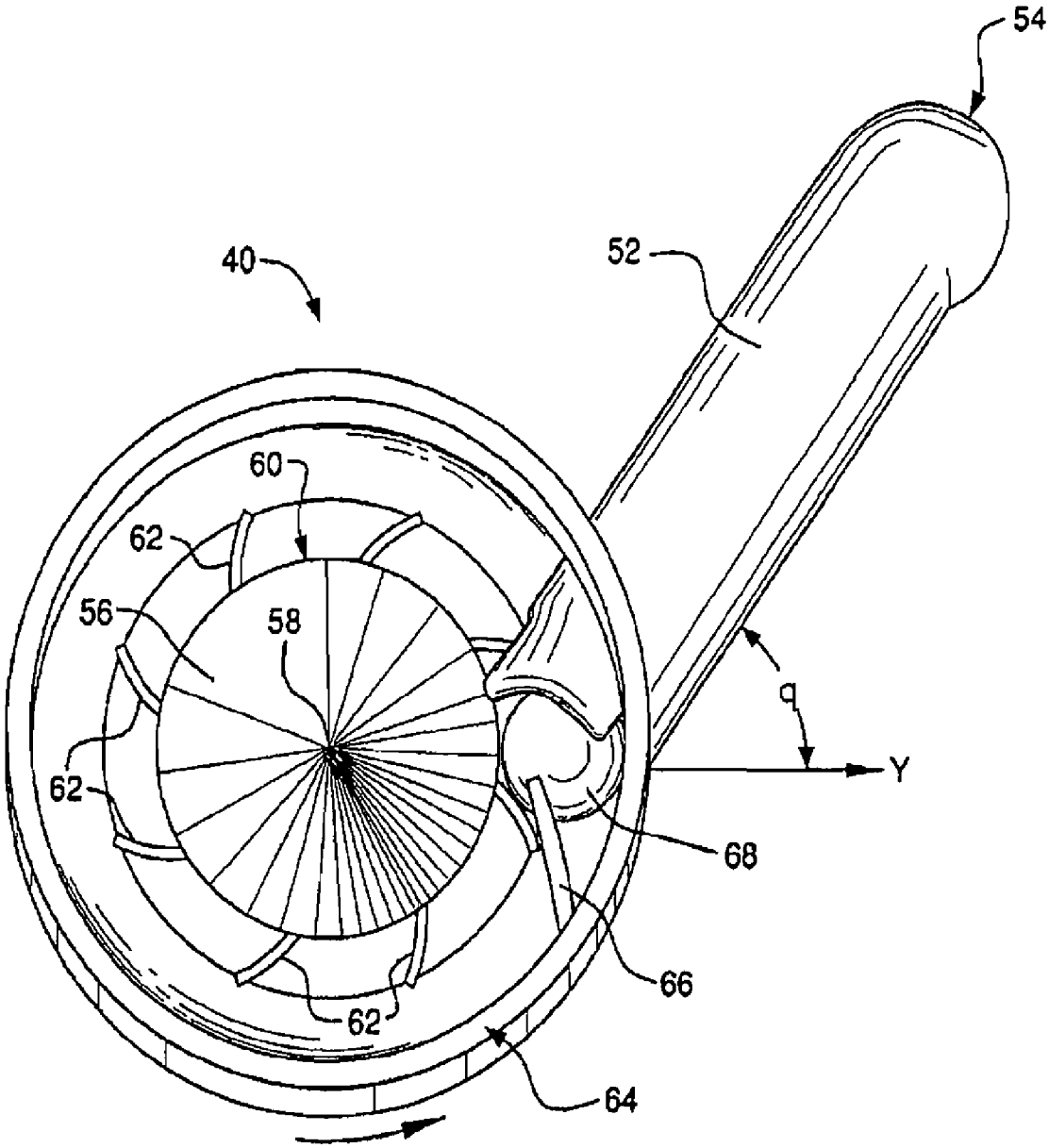
FIG. 2 ( PRIOR ART )
FIG. 2 is a top view of a drive cone of a paintball loader.

FIG. 2 is a top view of the lower portion 50 of a rapid feed paintball loader 40 showing a drive cone 56 of a paintball loader 40. Mounted along a vertical center axis 58, located in the approximate center of the interior area 46, is the drive cone 56 having a conically-shaped interior surface area 60 with a plurality of fins 62 projecting upwardly from the top surface of the drive cone 56 and spiraling outwardly from an outer circumference of the interior area 46. The drive cone 56 is rotatably attached to a bottom portion of the paintball container 42, allowing rotation about the center axis 58. The exit tube 52 projects outwardly from a rim 64 of the lower portion 50 of the container wall 44 at an approximately 45 degree angle from the Y-axis. In addition, an upper part of the exit tube 52 extends towards the interior area 46 to form a paintball tube extension 72. A pivotable deflector 66 extends inwardly towards the vertical center axis from the rim 64. A paintball 68 is illustrated between two fins 62.

The drive cone 56 shown in FIG. 2 positions the plurality of fins 62 in such a fashion that only one paintball 68 may fit in between two fins 62. Since only one paintball may fit in each gap, there is an increased possibility that a paintball may only partially fall into the gap. By merely falling partially into the gap, the paintball may cause a jam. Additionally, since there are several fins 62 located on the drive cone 56, the space used for accommodating paintballs 68 is reduced by the number of fins 62. Also, when a paintball breaks within the paintball loader 40, since there are so many fins 62, and the gaps between the fins 62 are relatively small, cleaning the residue of the broken paintball may be very difficult.

Figure 3:
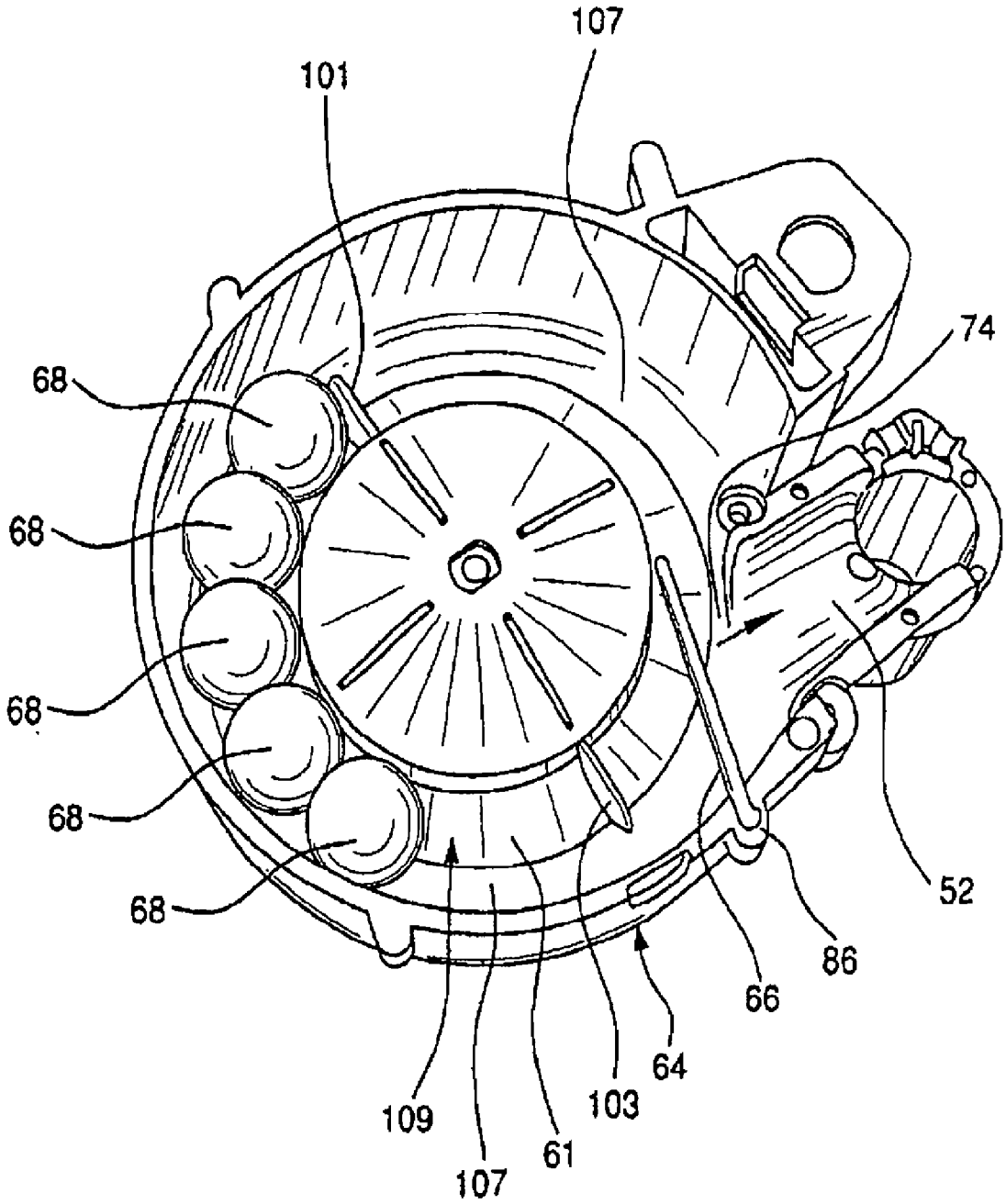
FIG. 3 is a top interior cutaway view of the paintball loader illustrating an improved cone, the exit tube, and a plurality of paintballs in the preferred embodiment of the present invention.

FIG. 3 is a top interior cutaway view of the paintball loader 40 illustrating an improved cone 99, the exit tube 52, and a plurality of paintballs 68 in the preferred embodiment of the present invention. The container wall 44 is curved and extends upwards to form the upper portion 48 (not shown in FIG. 3). The interior area 46, formed by the container wall 44, stores a plurality of paintballs 68 prior to being used by the paintball gun 20. Although a circular shape is illustrated in the top view of FIG. 3, the container 42 may be any size and shape which permits the paintballs 68 to drop towards the drive cone 99.

Figure 4:
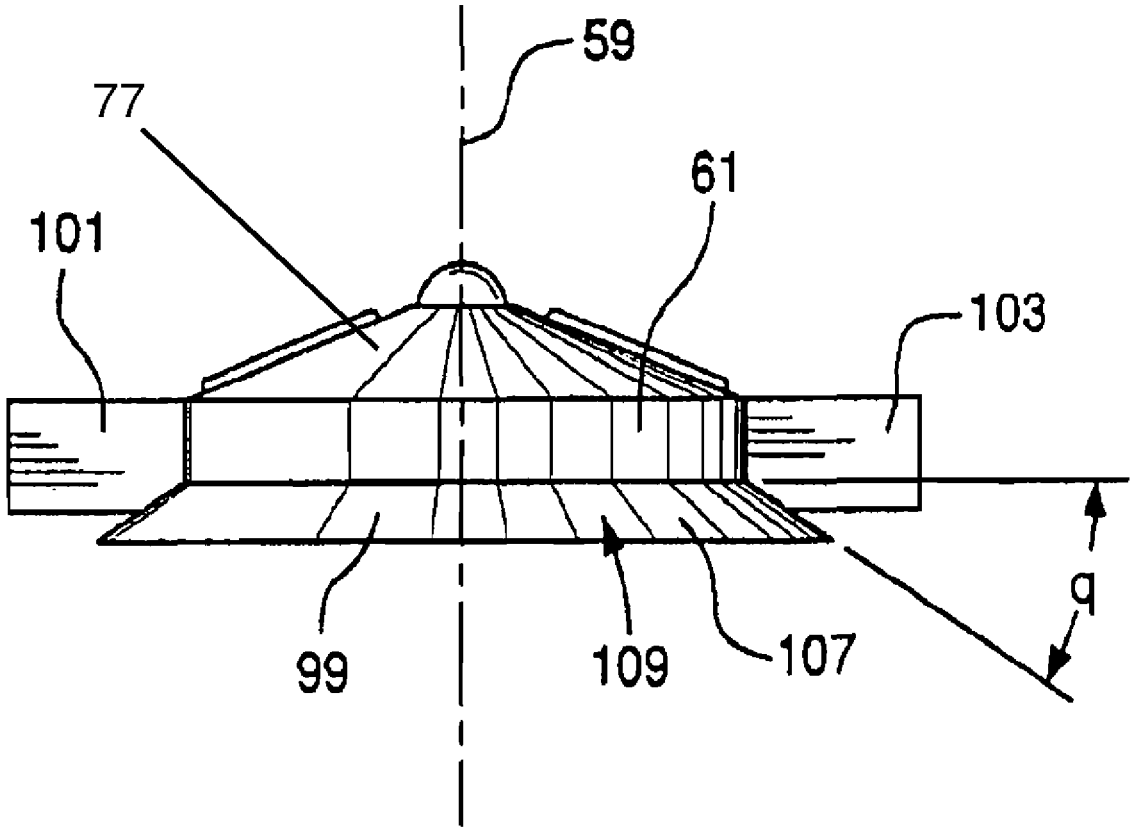
FIG. 4 is a side view of the drive cone of FIG. 3 separated from the paintball loader in the preferred embodiment of the present invention.
Figure 5:
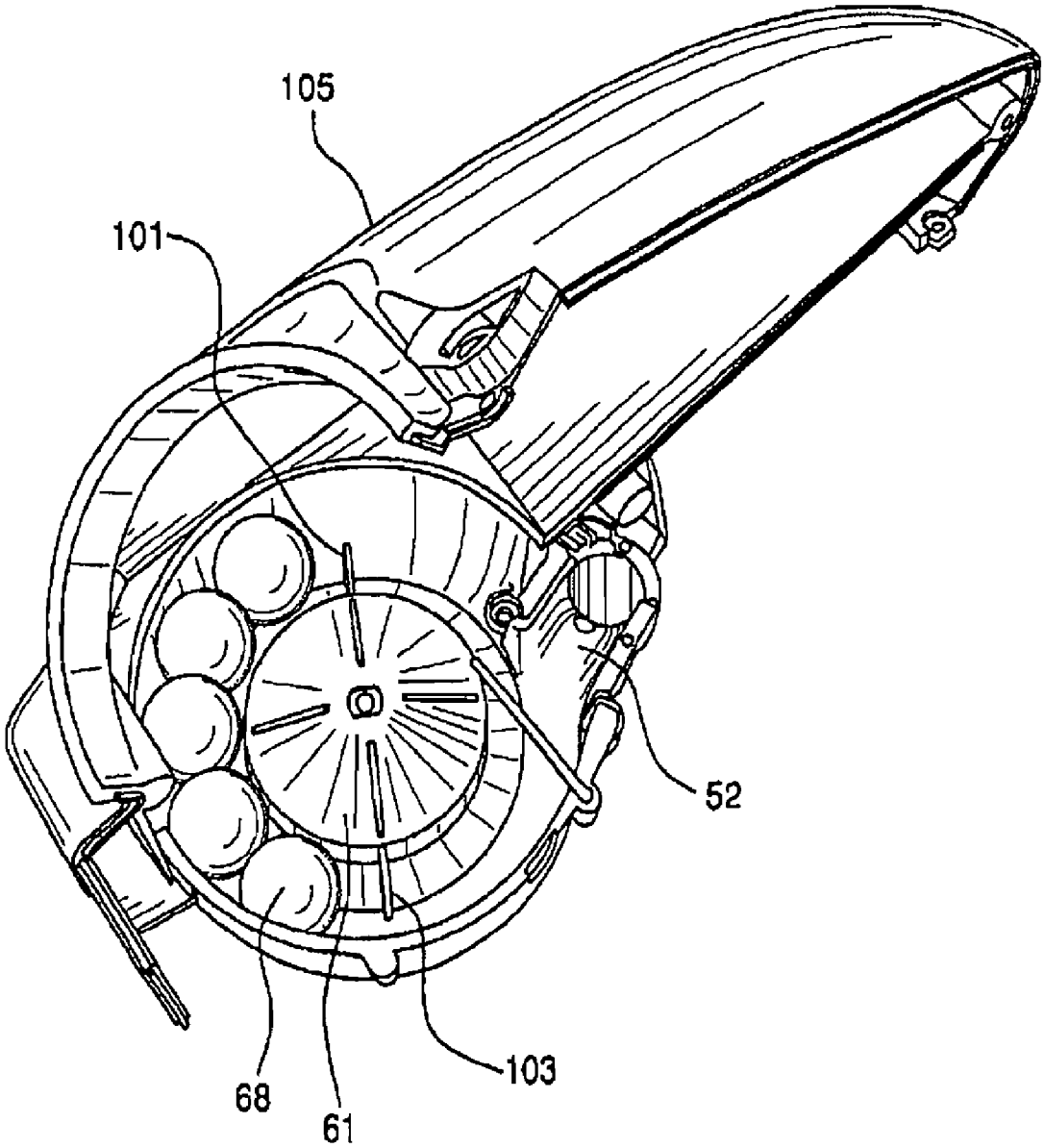
FIG. 5 is a top interior cutaway view of the paintball loader illustrating the improved drive cone, the exit tube, a plurality of paintballs, and an outer shell of the paintball loader in the preferred embodiment of the present invention.
Figure 6:
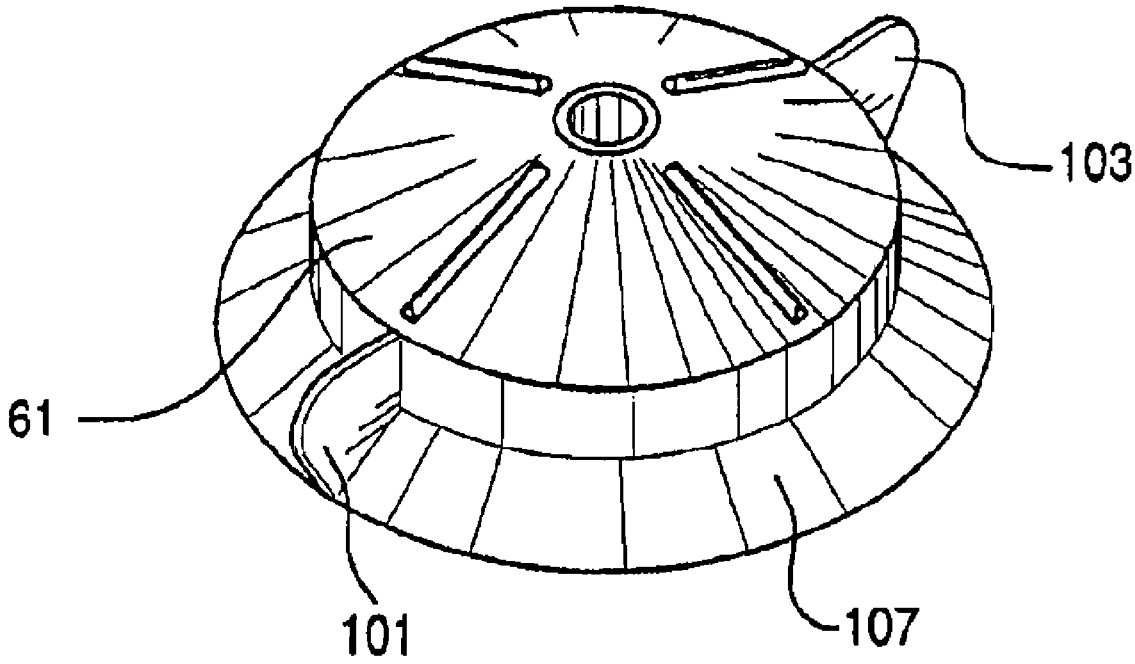
FIG. 6 illustrates a top perspective view of the drive cone of FIG. 4.

FIG. 4 is a side view of the drive cone 99 of FIG. 3 separated from the paintball loader 40 in the preferred embodiment of the present invention. In the preferred embodiment of the present invention, the drive cone 99 includes two fins 101 and 103. FIG. 5 is a top interior cutaway view of the paintball loader 40 illustrating the improved drive cone 99, the exit tube 52, a plurality of paintballs 68, and an outer shell 105 of the paintball loader 40 in the preferred embodiment of the present invention. FIG. 6 illustrates a top perspective view of the drive cone 99 of FIG. 4.

Referring to FIGS. 3-6, the drive cone 99 includes a conically-shaped interior area 61. The two fins originate at an outer circumference of the interior area 61 and project outwardly towards the rim 64 of the container wall 44. Between each fin is an enlarged gap 107 which may accommodate a plurality of paintballs 68 (as illustrated, five paintballs 68 may be positioned between each gap 107). However, the drive cone 99 may be sized to accommodate any amount of paintballs 68.

After the paintball enters the entry opening, the next paintball located adjacent the first paintball within the gap 107 is sequentially grasped by the tube extension and driven into the entry opening 74 behind the first paintball. Additional paintballs 68 located in the container 42, are drawn downwardly and outwardly by gravity and fill the vacated gaps. Positioning the fins 101, 103 on the outer circumference of the interior dome-shaped area 77 prevents paintballs 68 from being lodged in the upper portions of the gaps.

A tube extension (shown in FIG. 2) is preferably located at the entry opening 74. The tube extension is an extension of the exit tube 52. The tube extension extends towards a center axis 59, while maintaining a clearance above the fins 101 and 103. The paintball tube extension is formed as a scoop which has an interior radius of curvature approximately equal to the curvature of a paintball. The top of the scoop is positioned so that it partially covers a paintball that is pushed into position by the fins 101, 103 at the entry opening 74 of the exit tube 52. In this manner, the sloped surface of the drive cone 99, the fins 101, 103, the angled orientation (approximately 45 degrees)

of the exit tube 52, and the tube extension all equate to forcibly drive the paintball into the exit tube 52.

The drive cone 99 is rotated around the center axis 59 by a drive motor 70 (shown in FIG. 1). Additionally, the pivotable deflector 66 may be installed within the loader 40. The pivotable deflector 66 is attached to the rim 64 at pivot point 86, allowing the deflector to rotatably move as indicated in FIG. 3.

Referring to FIGS. 1, and 3-6, the operation of the rapid feed paintball loader 40 having the improved drive cone 99 will now be explained. The rapid feed paintball loader 40 is positioned on the top of the paintball gun 20. The loader 40 is connected to the gun 20 by attaching the exit tube 52, at the outlet opening 54, to the inlet tube 32 with an attaching device such as a clamp (not shown).

When an operator of the paintball gun 20 wishes to shoot paintballs, the trigger 34 is squeezed, which actuates the compressed gas cylinder 24. The compressed gas cylinder 24 releases bursts of compressed gas which are used to eject paintballs 68 through the barrel 28. A plurality of paintballs 68 are stored in the paintball container 42 and pass down the exit tube 52 for use by the paintball gun 20 when demanded by the operator.

The plurality of paintballs 68 located in the container 42 rest on top of the drive cone 99. The bottom-most paintballs 68 drop into either of the two enlarged gaps 107. The drive cone 99 is rotated by the drive motor 70, forcing the paintballs 68 outward and downward from the center axis 59 and forward toward the tube extension. The pivotable deflector 66 helps prevent jams by causing paintballs 68 to either fall into one of the gaps between the fins 101, 103 or to rise above the tube extension. The paintball 68 is forced into the entry opening 74 of the exit tube 52 by the tube extension. In addition, since the drive cone 99 is downwardly sloped toward the exit tube 52, the paintball falls downwardly, with the assistance of gravity, and outwardly towards the rim 64.

After the paintball enters the entry opening, the next paintball located adjacent the first paintball within the gap 107 is sequentially grasped by the tube extension and driven into the entry opening 74 behind the first paintball. Additional paintballs 68 located in the container 42, are drawn downwardly and outwardly by gravity and fill the vacated gaps. Positioning the fins 101, 103 on the outer circumference of the interior dome-shaped area prevents paintballs 68 from being lodged in the upper portions of the gaps.

Once the paintball 68 enters the entry opening 74, it passes through the sloped exit portion to a vertical outlet portion of the exit tube 52. As the paintball passes through the exit tube 52, the paintball may actuate an optional electro-mechanical motor actuator switch/sensor 83 (shown in FIG. 3). As shown in FIG. 3, the motor actuator switch 83 may be utilized to detect the paintball passing through the exit tube 52. When the paintball 68 enters the exit tube 52, the motor actuator detects the paintball in the exit tube 52 and shuts off the motor 70. Thus, when the exit tube 52 fills up with paintballs, the motor 70 is automatically turned off. Then as paintballs 68 vacate the exit tube 52, the motor actuator does not detect a paintball and engages the motor 70 and rotates the drive cone 99. In this way, the exit tube 52 is always kept full of paintballs, ready for use when demanded by the paintball gun 20.

Although an electromechanical switch has been described to detect the presence of paintballs 68 in the exit tube 52, it should be understood that other devices may also be utilized to detect the paintballs 68 (e.g., infrared sensors, contact pads, optical sensors, etc.), without departing from the scope of the present invention. In the preferred embodiment, a reflective infrared (IR) optical sensor 83 may be utilized.

The pivotable deflector 66 may optionally be used to provide an additional, active device to prevent the jamming of paintballs 68 within the paintball loader. In existing paintball loaders, a paintball may be lodged between the tube extension or entry opening 74 of the exit tube 52 and one of the fins 101, 103 or "agitators" driving the paintball towards the exit tube 52, causing the loader to jam and stopping the rotation of the drive cone 99. To prevent the paintball from lodging between the tube extension (or extension of the exit tube 52 in existing loaders) and a fin (or agitator in existing loaders), the pivotable deflector 66 forces the paintball to either fall into one of the gaps between the fins 101, 103 or to rise upwardly away from the tube extension. In addition, the deflector pivots away from the paintball, thus preventing the paintball from lodging between the fin and the deflector. The deflector, although depicted with the paintball loader 40 illustrated in FIGS. 1-5, may be utilized on any active feed paintball loader to prevent the inadvertent lodging of paintballs 68 between a fin (or other agitating device) and the entry of the exit tube 52.

The improved drive cone 99 provides many advantages over existing drive cones. First of all, by enlarging the gaps to allow the accommodation of more paintballs, more paintballs 68 are fed into the entry opening 74 for each rotation of the drive cone 99. By feeding the paintballs 68 at a greater rate per rotation of the drive cone 99, the drive cone 99 enables the paintball loader 40 to feed the paintball gun 20 at a faster rate than existing drive cones. In addition, in existing paintball drive cones, the gaps between the fins 101, 103 only allow the accommodation of a single paintball. This reduced area in existing drive cones results in an increased likelihood that the paintball may only partially fall into the smaller gap. When the paintball can only fall partially into the smaller gap of the existing drive cones, a jam results between the paintball and fin. With the improved drive cone 99, the paintball has a large area for which the paintball may fall into. This results in less partial drops of the paintballs 68 into the gaps, which decreases or eliminate any jams which may occur.

The improved drive also allows for easy cleanup of the interior of the paintball loader 40 when paintballs 68 break within the loader 40. In addition, the improved drive cone 99 allows for manual feeding of the paintball when the feed system of the paintball loader malfunctions. For example, when a motor 70 fails on the paintball loader 40, a paintball gun 20 operator need only shake the gun 20 to move the paintballs 68 into the gun 20.

Figure 7:
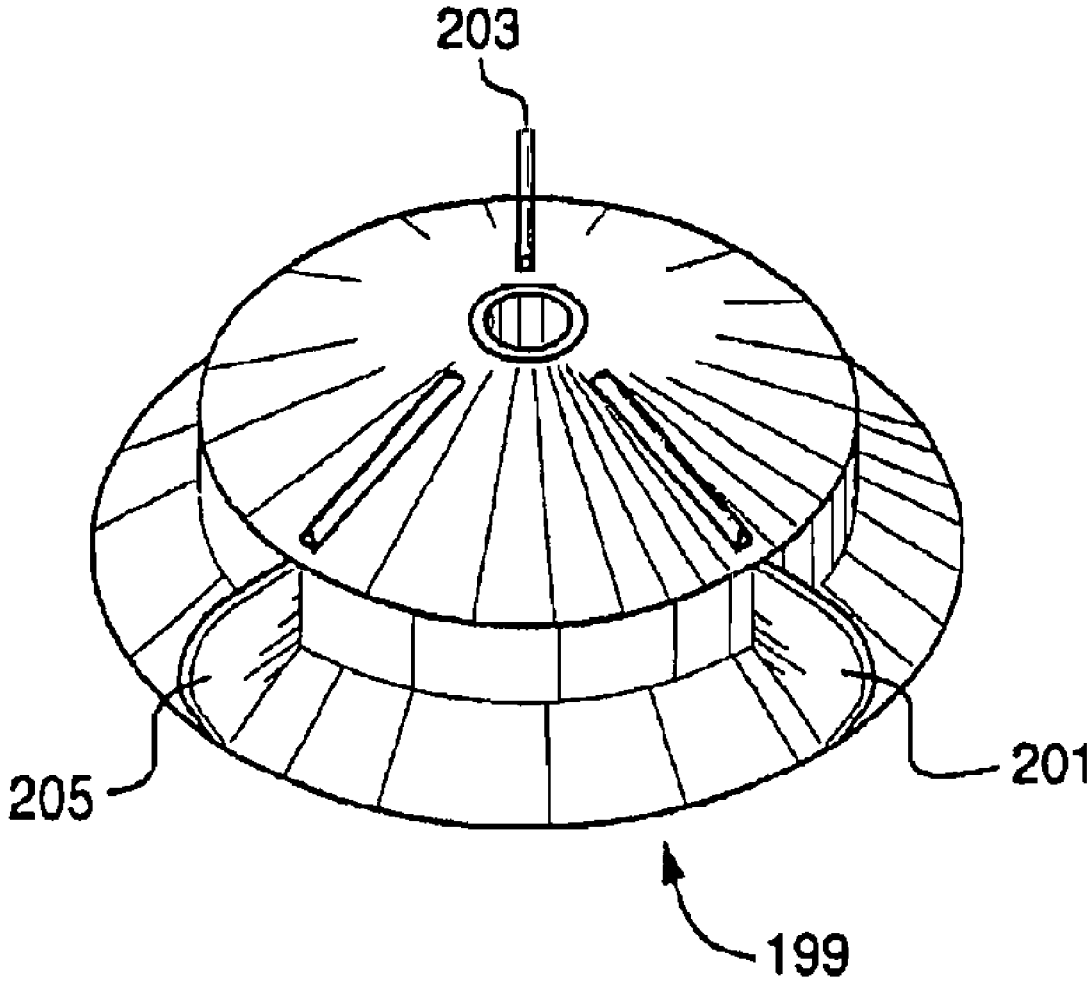
FIG. 7 illustrates a separate drive cone having three fins in a first alternate embodiment of the present invention.
Figure 8:
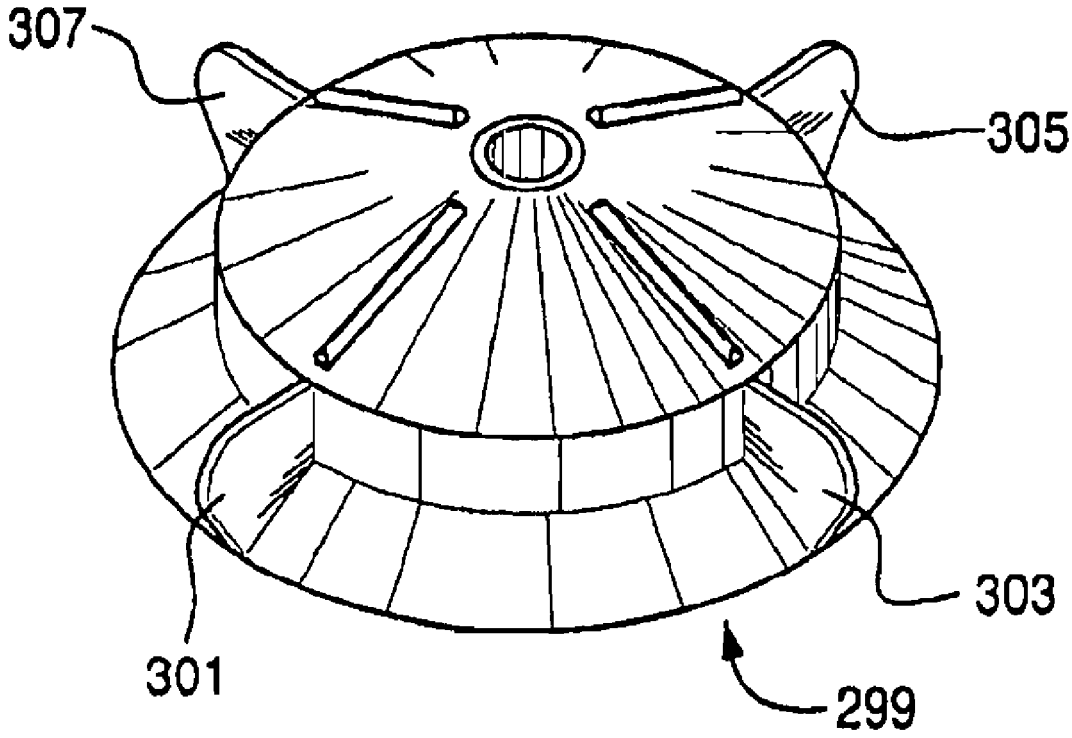
FIG. 8 illustrates a drive cone having four fins in a second alternate embodiment of the present invention.
Figure 9:
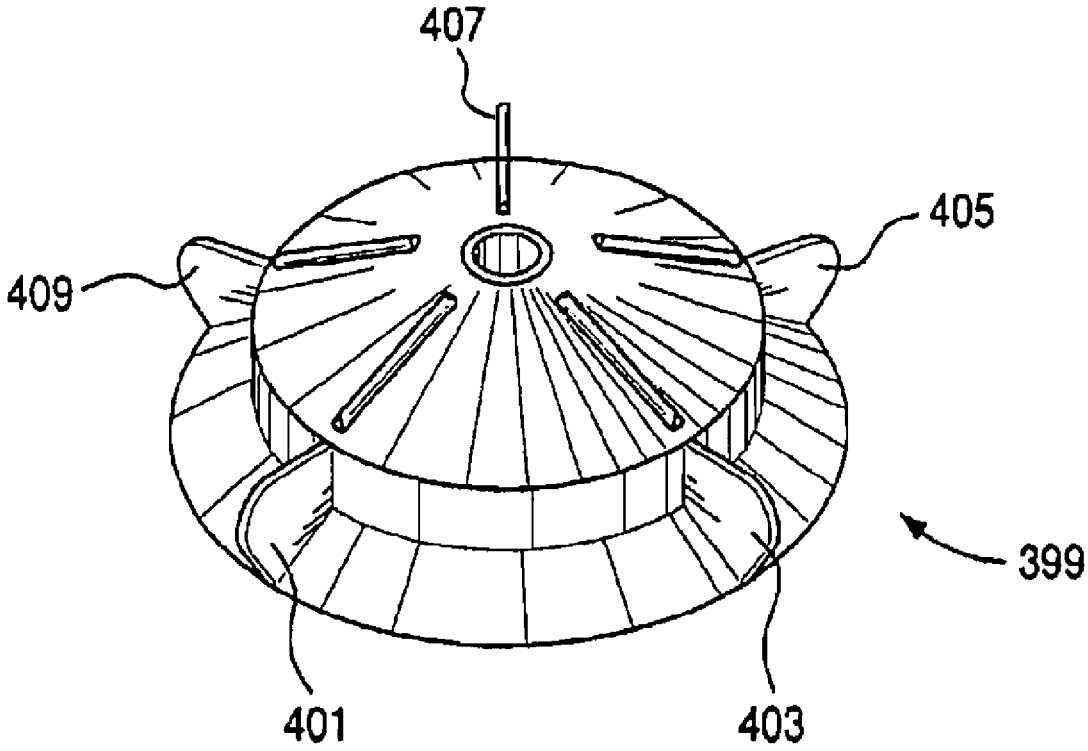
FIG. 9 illustrates a separate drive cone having five fins in a third alternate embodiment of the present invention.

The improved drive cone 99 only requires one fin 101. However, in alternate embodiments of the present invention, the drive cone 99 may have more than one fin. FIG. 7 illustrates a separate drive cone 199 having three fins 201,203, and 205 in a first alternate embodiment of the present invention. FIG. 8 illustrates a drive cone 299 having four fins 301, 303, 305, and 307 in a second alternate embodiment of the present invention. FIG. 9 illustrates a separate drive cone 399 having five fins 401, 403, 405, 407, and 409 in a third alternate embodiment of the present invention. It should be understood that the drive cone may have any number of fins which allows the accommodation of more than one paintball within each formed gap. In addition, the drive cone may be used on a wide variety of paintball loaders.

In the preferred embodiment of the present invention, the paintball loader 40 may include a microprocessor 82 (FIG. 1) to enhance the performance of the loader 40 as well as providing useful information to a paintball gun 20 operator (not shown). The microprocessor 82 also deactivates the drive motor 70 when the exit tube 52 is full. The microprocessor 82 is attached to or in communication with the motor actuator switch 83 (FIG. 3) and is attached to or in communication with the motor 70 (FIG. 1). When the motor actuator switch 83 detects the presence of a paintball at the top of the exit tube 52, the motor actuator switch 83 sends a signal to the microprocessor 82. In turn, the microprocessor 82 sends a signal to disengage the motor 70. When the motor actuator switch 83 does not detect any paintballs 68 within the exit tube 52, the motor actuator switch 83 signals the microprocessor 82 that the exit tube 52 is empty. The microprocessor 82 can then signal the motor 70 to engage and rotate the drive cone, providing additional paintballs 68 to the paintball gun 20.

It is thus believed that the operation and construction of the present invention will be apparent from the foregoing description. While the apparatus shown and described has been characterized as being preferred, it will be readily apparent that various changes and modifications could be made therein without departing from the scope of the invention as defined in the following claims.

What is claimed is:

1. A rapid feed paintball loader for use on a paintball gun for force feeding paintballs, the paintball loader comprising:

a container for holding a plurality of paintballs;

a paintball agitator rotatably mounted in the container, the paintball agitator rotating about an axis;

the paintball agitator comprising at least two fins extending substantially perpendicular to the axis of rotation of the paintball agitator, the fins spaced apart from each other forming a gap therebetween large enough to accommodate more than one paintball;

at least two paintballs positioned in the gap between the fins;

a motor configured to rotate the paintball agitator;

an exit tube exiting from the bottom portion of the container and leading to an inlet tube of the paintball gun;

and, a microprocessor for controlling operation of the motor;

the paintball agitator configured to receive paintballs from the container in the gap and force the paintballs from the gap into the exit tube; and a sensor for detecting a paintball, and wherein the microprocessor is in communication with the sensor and receives signals from the sensor;

wherein the paintball agitator includes a central dome-shaped area, wherein the fins extend outwardly from the dome-shaped area.

2. The rapid feed paintball loader of claim 1, wherein the sensor is a reflective infrared sensor.

3. The rapid feed paintball loader of claim 1, wherein the paintball agitator includes at least three fins extending perpendicularly to the axis of rotation of the paintball agitator, each fin forming a gap with an adjacent fin large enough to accommodate more than one paintball, further comprising at least two paintballs between any two adjacent fins.

4. The rapid feed paintball loader of claim 1, wherein the paintball agitator includes at least four fins extending perpendicularly to the axis of rotation of the paintball agitator, each fin forming a gap with an adjacent fin large enough to accommodate more than one paintball, further comprising at least two paintballs between any two adjacent fins.

5. The rapid feed paintball loader of claim 1, wherein the exit tube includes a sloped exit portion.

6. A rapid feed paintball loader for use on a paintball gun for force feeding paintballs, the paintball loader comprising:

a container for holding a plurality of paintballs;

a paintball agitator rotatably mounted in the container, the paintball agitator rotating about an axis;

the paintball agitator comprising at least two fins extending substantially perpendicular to the axis of rotation of the paintball agitator, the fins spaced apart from each other forming a gap therebetween large enough to accommodate more than one paintball;

at least two paintballs positioned in the gap between the fins;

a motor configured to rotate the paintball agitator;

an exit tube exiting from the bottom portion of the container and leading to an inlet tube of the paintball gun;

and, a microprocessor for controlling operation of the motor;

the paintball agitator configured to receive paintballs from the container in the gap and force the paintballs from the gap into the exit tube; and a deflector for deflecting paintballs downward into the gap or upward away from the gap, the deflector movably attached to the interior surface of the container.

* * * * *

UNITED STATES PATENT AND TRADEMARK OFFICE

CERTIFICATE OF CORRECTION

PATENT NO. : 8,061,342 B2
APPLICATION NO. : 12/040119
DATED : November 22, 2011
INVENTOR(S) : Christopher et al.

It is certified that error appears in the above-identified patent and that said Letters Patent is hereby corrected as shown below:

Claim 6, column 8, line 35, after "microprocessor" insert --in communication with a sensor--

Signed and Sealed this
Eighth Day of May, 2012

David J. Kappos

David J. Kappos
*Director of the United States Patent and Trademark Office*